US009694891B2

(12) United States Patent
Monahan

(10) Patent No.: US 9,694,891 B2
(45) Date of Patent: Jul. 4, 2017

(54) DOWNWARDLY MOUNTED DRAG INDUCING STEERING CONTROL FIN

(71) Applicant: Michael P. Monahan, Phoenix, NY (US)

(72) Inventor: Michael P. Monahan, Phoenix, NY (US)

( * ) Notice: Subject to any disclaimer, the term of this patent is extended or adjusted under 35 U.S.C. 154(b) by 139 days.

(21) Appl. No.: 14/807,100

(22) Filed: Jul. 23, 2015

(65) Prior Publication Data

US 2016/0023738 A1 Jan. 28, 2016

Related U.S. Application Data

(60) Provisional application No. 62/028,440, filed on Jul. 24, 2014.

(51) Int. Cl.
*B63H 25/04* (2006.01)
*B63H 20/00* (2006.01)

(52) U.S. Cl.
CPC ..... *B63H 20/007* (2013.01)

(58) Field of Classification Search
CPC ..... B63H 20/007
See application file for complete search history.

(56) References Cited

U.S. PATENT DOCUMENTS

| | | | | |
|---|---|---|---|---|
| 3,285,219 | A | 11/1966 | Linsley | |
| 4,211,180 | A | 7/1980 | Brooks, Jr. | |
| 4,634,388 | A | 1/1987 | Covell | |
| 4,643,686 | A * | 2/1987 | Blanchard | B63H 20/08 114/162 |
| 4,944,702 | A | 7/1990 | Cain | |
| 5,102,359 | A | 4/1992 | Hinds | |
| 5,902,157 | A | 5/1999 | Boris | |
| 8,430,047 | B1 | 4/2013 | Dill | |
| 2009/0037040 | A1 * | 2/2009 | Salmon | B63B 17/00 701/21 |

* cited by examiner

*Primary Examiner* — Stephen Avila
(74) *Attorney, Agent, or Firm* — Harrie Beach PLLC

(57) ABSTRACT

A steering control fin for mounting to a trolling motor includes a skin formed into a substantially symmetric closed fin shape having a fin width. The skin has a first end surface contoured to match the shape of a motor, and a trailing edge having an anti-rotation interlock cut-out near the first end surface. A reinforcement collar has a reinforcement collar surface that substantially matches the first end surface. An internal support structure is mechanically coupled to the steering control fin to provide a structural support which maintains the substantially symmetric closed fin shape. An end cap skin is mechanically coupled to a second end surface of the skin. One or more mounting straps are mechanically coupled to the skin and each of the reinforcement collars. The mounting straps mechanically affix the control fin to the trolling motor. A method of maneuvering a boat or ship is also described.

13 Claims, 16 Drawing Sheets

DOWNWARDLY MOUNTED DRAG INDUCING STEERING CONTROL FIN

CROSS-REFERENCE TO RELATED APPLICATIONS

This application claims priority to and the benefit of co-pending U.S. Provisional Patent Application Ser. No. 62/028,440, DOWNWARDLY MOUNTED DRAG INDUCING STEERING CONTROL FIN, filed Jul. 24, 2014, which application is incorporated herein by reference in its entirety.

FIELD OF THE INVENTION

The invention relates to boat and ship steering and particularly to an apparatus for maneuvering at slow speeds.

BACKGROUND OF THE INVENTION

Trolling is a method of fishing that uses a slow motion of a boat, rather than a cast & reel, to cause fishing lures to move through the water. Trolling allows the fisherman to use, multiple lines, at the same time, as well as to cover a larger area in a shorter amount of time.

SUMMARY OF THE INVENTION

According to one aspect, a steering control fin for mounting to a trolling motor includes a skin formed into a substantially symmetric closed fin shape having a fin width. The skin has a first end surface contoured to match the shape of a motor, and a trailing edge having an anti-rotation interlock cut-out near the first end surface. Each reinforcement collar of a pair of reinforcement collars is affixed to each of a first side and a second side of the steering control fin. Each reinforcement collar has a reinforcement collar surface that substantially matches the first end surface. An internal support structure is mechanically coupled to the first side and the second side of the steering control fin to provide a structural support which maintains the substantially symmetric closed fin shape. An end cap skin is mechanically coupled to a second end surface of the skin. One or more mounting straps are mechanically coupled to the skin and each of the reinforcement collars. The mounting straps mechanically affix the control fin to the trolling motor.

In one embodiment, the skin includes a metal.

In another embodiment, the metal includes galvanized steel or aluminum.

In another embodiment, the skin includes a non-metallic material such as plastic, carbon composite, or fiber glass.

In yet another embodiment, the skin includes an overlapping seam.

In yet another embodiment, the overlapping seam includes a plurality of rivets.

In yet another embodiment, the internal support structure includes one or more internal baffles.

In yet another embodiment, the internal support structure is mechanically coupled to the skin by a plurality or rivets.

In yet another embodiment, the one or more mounting straps include adjustable clamps.

In yet another embodiment, the fin width is more than about one tenth of a fin length dimension so as to cause substantial drag while allowing for maneuverability.

In yet another embodiment, the steering control fin further includes a plurality of depth indication marks on the skin.

In yet another embodiment, the steering control fin includes a forward edge and a trailing edge and the forward edge and the trailing edge are substantially symmetric fore and aft.

According to another aspect, a method of maneuvering a boat for fishing by trolling includes the steps of: providing a steering control fin mounted below a trolling propulsion unit by two or more radii of a trolling propulsion unit propeller below a bow or side mounted trolling propulsion unit of the boat, the steering control fin having a fin thickness that causes a substantial drag while allowing maneuverability; trolling at a relatively slow speed, by use of the substantial drag caused by the steering control fin; and changing a direction of the boat rapidly by steering the bow or side mounted trolling propulsion unit having the steering control fin affixed thereto for improved maneuverability.

In one embodiment, the step of changing direction of the boat further includes the step of steering a primary stem mounted motor or boat rudder while steering the bow mounted motor having the steering control fin affixed thereto for improved maneuverability.

In another embodiment, the step of changing direction of the boat includes steering the steering control fin by use of a foot pedal.

According to yet another aspect, a method of fishing by trolling with a foot directional controlled trolling motor having a steering control fin includes the steps of: providing a steering control fin extending more than two propeller radii below a trolling motor propeller, the steering control fin mechanically coupled to and mounted substantially below a bow mounted trolling motor of a boat, the steering control fin having a fin thickness that causes a substantial drag while allowing maneuverability; trolling at a relatively slow speed, by use of the trolling motor as modified by a substantial drag caused by the steering control fin; detecting a school of fish as indicated by a fish finder or two or more bites or nibbles by fish on two or more trolling lines within a predetermined length of time; and starting a main propulsion motor and changing a direction of the boat rapidly to remain in a vicinity of the school of fish by steering the steering control fin by a trolling motor direction control by foot operation irrespective of whether of the trolling motor is operating or not.

According to yet another aspect, a steering control fin for maneuvering a boat or ship includes a control fin mechanically coupled to and disposed substantially below a motorized propulsion unit of the boat or ship. The control fin extends more than two radii of a motorized propulsion unit propeller or in an absence of a propeller more than a height of the propulsion unit below the propulsion unit. The steering control fin is adapted to augment slow speed maneuvering of the ship.

In one embodiment, the propulsion unit includes a bow thruster.

In another embodiment, the boat or ship includes a hydrofoil.

The foregoing and other objects, aspects, features, and advantages of the invention will become more apparent from the following description and from the claims.

BRIEF DESCRIPTION OF THE DRAWINGS

The objects and features of the invention can be better understood with reference to the drawings described below, and the claims. The drawings are not necessarily to scale, emphasis instead generally being placed upon illustrating the principles of the invention. In the drawings, like numerals are used to indicate like parts throughout the various views.

DETAILED DESCRIPTION

As described hereinabove, trolling is a method of fishing that uses an outboard motor to cause lures to move through the water, rather than by cast & reel. Many modern boat hulls and outboard motors are designed for lowest possible drag in the water. One of the problems in trolling is that with such efficient hulls, it can be difficult to achieve desired slow speed trolling speeds through the water. Also, it can be difficult to maneuver boats at slow trolling speeds.

Bow mounted motors such as attachable electric bow mounted motor prop thrusters can be helpful in maneuvering a boat, however existing bow thrusters and bow trolling motors provide less maneuverability at trolling speeds than desired.

It was realized that a solution to the problem of slow speed maneuverability for trolling is to add a steering control fin that extends downward into the water from substantially below the body of a propulsion motor, such as a bow mounted electric trolling motor. The steering control fin can be made to have a relatively thick symmetric airfoil like shape to intentionally cause drag in the water at the bow of the boat. For additional convenience of operation, as known in the art, the direction of the bow trolling motor on a standard pivoting mount can be controlled by foot pedals or by any other suitable wired or wireless control means.

The steering control fin solution as described hereinbelow in more detail is counter-intuitive for a number of reasons. Typically fins mounted on motors and thrusters are about at the level of the prop, above the prop, or mostly at and above the prop, occasionally with a small portion of the fin extending below the prop or motor. One reason that fins have not been used below the motor is probably to limit draft to allow the boat or ship to traverse the shallowest possible waters without scraping the fin. However, it was realized that best trolling performance of desired additional drag and improved maneuverability can be achieved by extending the steering control fin downward from the bottom of the trolling motor with most of the steering control fin extending below the trolling motor. The downward extent of steering control fin with respect to concerns for achieving the best possible shallow draft can be somewhat mitigated by mounting the trolling motor assembly so that the motor and prop are just below the surface of the water. Another counter-intuitive aspect of the steering control fin is that rather than designing the steering control fin for best possible efficient movement through the water, it was realized that intentionally adding significant drag can be advantageous for best maneuverability during slow speed movement of a boat through the water, such as during trolling.

Figure 1:
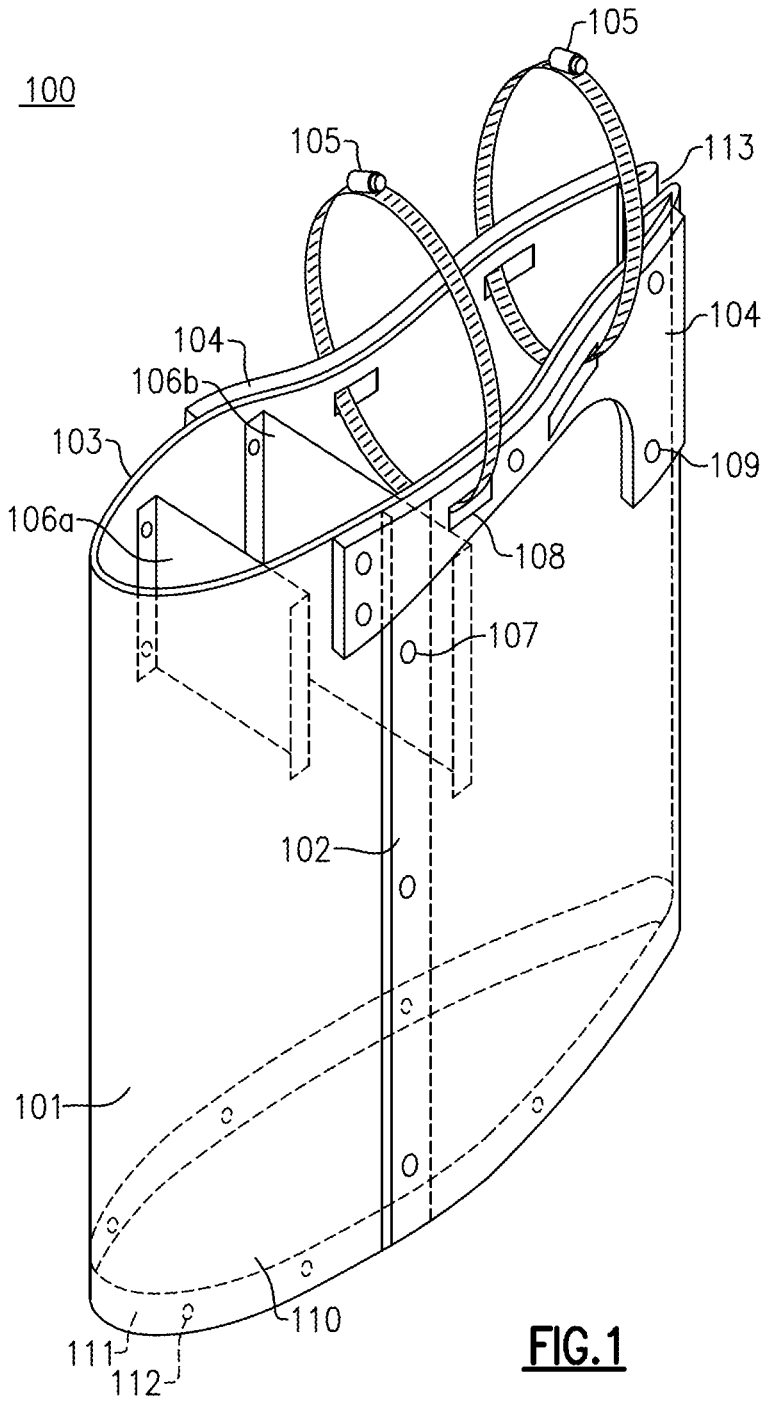
FIG. 1 shows an isometric view of one exemplary embodiment of a new steering control fin that extends downward from trolling motor.

FIG. 1 shows an isometric view of one exemplary embodiment of the new substantially downward extending steering control fin 100. The relatively thick substantially symmetric fin can be covered in a skin 101 of any suitable sheet material, usually a metal, such as, for example a no. 28 galvanized steel or aluminum. Other suitable non-metallic materials can be used such as plastics, carbon composites or fiber glass. The shape of the skin can be reinforced by any suitable internal structure, optionally including one or more internal baffles, such as for example, inner short baffle 106*a* and inner long baffle 106*b* of FIG. 1. The skin 101 can be affixed to the one or more baffles and joined to itself at a seam 102 (e.g. an overlapped seam) by a plurality of any suitable fasteners, such as, for example rivets. A top edge 103 of skin 101 can be contoured to match the shape of any suitable trolling motor assembly. Further, the top section of the steering control fin 100 can be reinforced by a pair of reinforcement collars 104. The top edge of the reinforcement collars 104 also follows the contour of the trolling motor and can substantially match the top edge 103 where the reinforcement collars 104 follow the top edge 103. One or more of any suitable straps or brackets can be used to affix the steering control fin 100 to the trolling motor assembly. For example, in the exemplary embodiment of FIG. 1, two attachment clamps 105 are used to affix the steering control fin 100 to the trolling motor. The bottom of the steering control fin 100 as defined by a bottom edge of skin 101 can be covered by a bottom insert 110 of any suitable sheet material, which can also be made from metal, such as, for example a no. 28 galvanized steel or aluminum. Other suitable non-metallic materials can be used such as plastics, carbon composites or fiber glass. The bottom insert 110 can also include a folded section flange 111 for convenient attachment to skin 101 by any suitable fasteners, such as by rivets 112. While the contoured top edge 103, contoured reinforcement collars 104 and attachment clamps 105 hold the steering control fin 100 securely to the bottom of the trolling motor assembly, because of the relatively high steering forces, an additional anti-rotation interlock cut-out 113 can provide a yet more positive stable mounting to the trolling motor.

Figure 2:
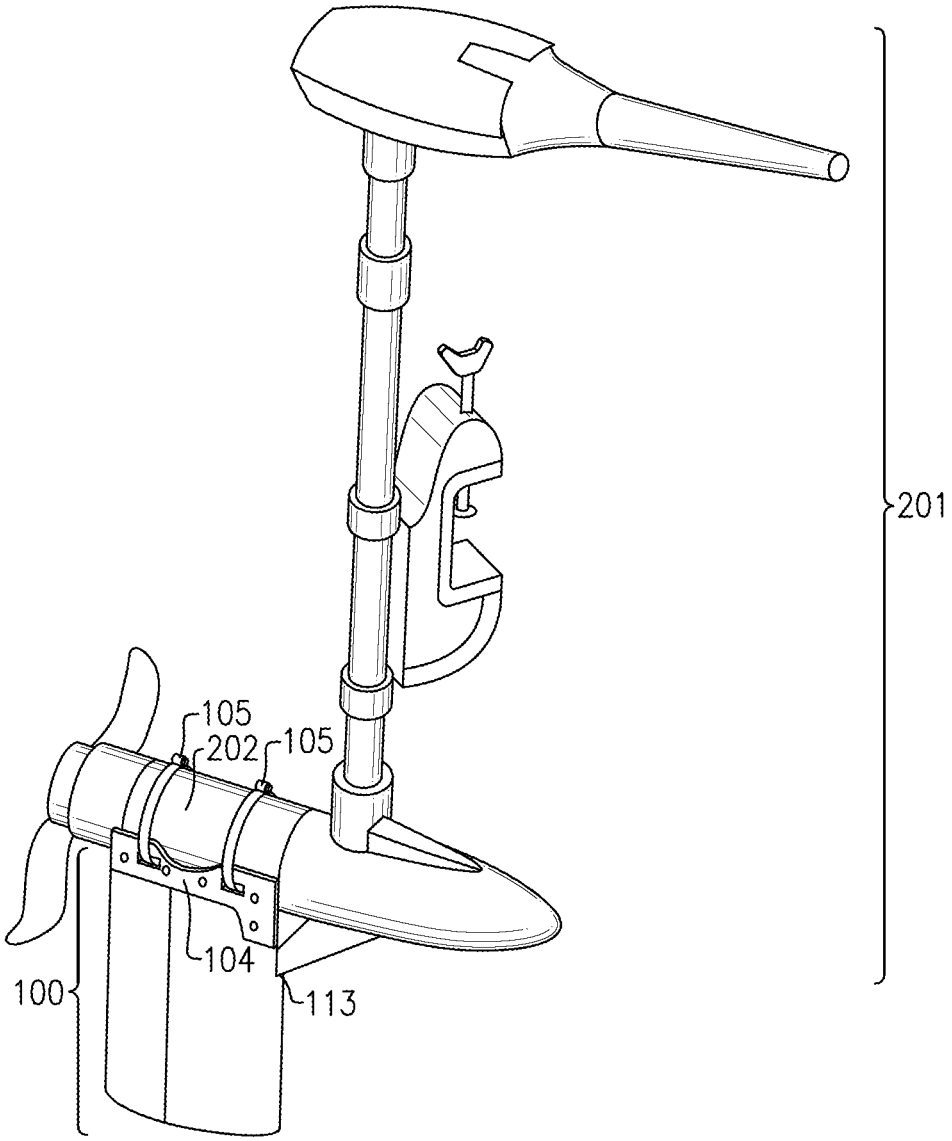
FIG. 2 shows an isometric view of a steering control fin of FIG. 1 attached to a trolling motor.

FIG. 2 shows an isometric view of a steering control fin 100 of FIG. 1 attached to an exemplary trolling motor assembly 201. Attachment clamps 105 hold the top edge 103 and reinforcement collars 104 securely against the bottom of the trolling motor. Further, a fin section of the trolling motor assembly 201 nests securely within the anti-rotation interlock cut-out 113.

Figure 3:
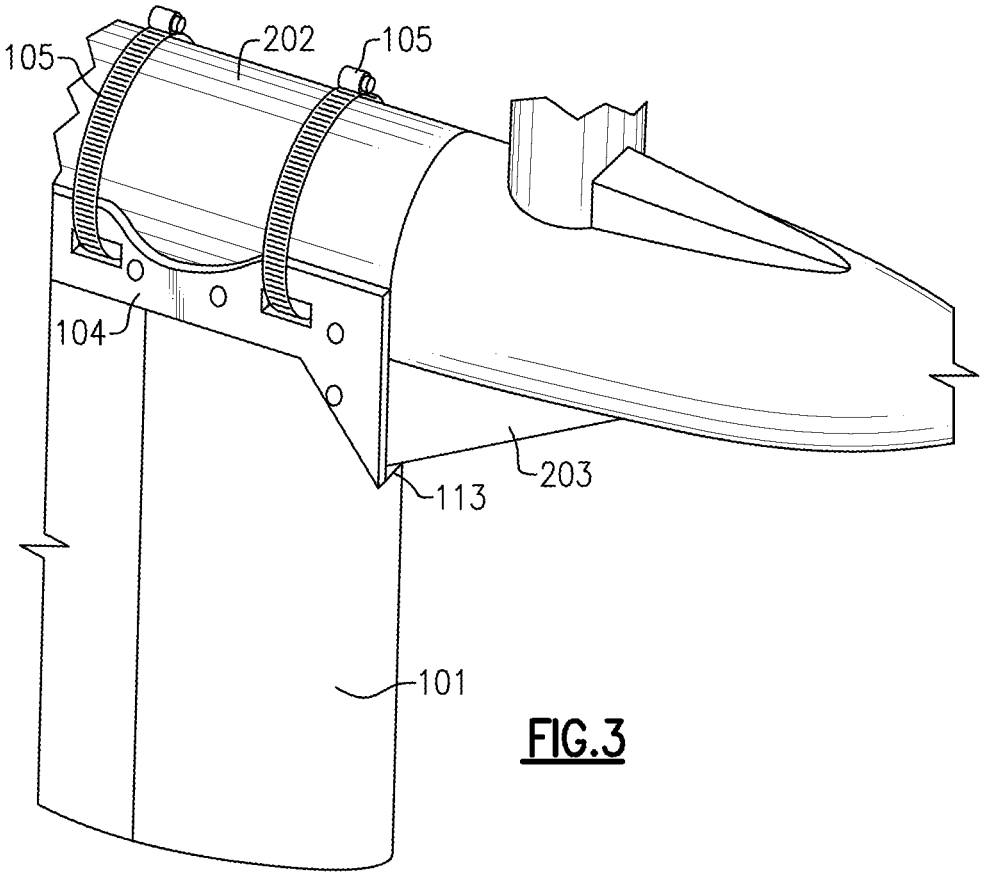
FIG. 3 shows a cut-away magnified view illustrating where exemplary attachment clamps hold the top edge and reinforcement collars securely against the bottom of the trolling motor.

FIG. 3 shows a cut-away magnified view of where attachment clamps 105 hold the top edge 103 and reinforcement collars 104 securely against the bottom of the trolling motor and where fin section 203 of the trolling motor assembly 201 nests securely within the anti-rotation interlock cut-out 113.

Figure 4B:
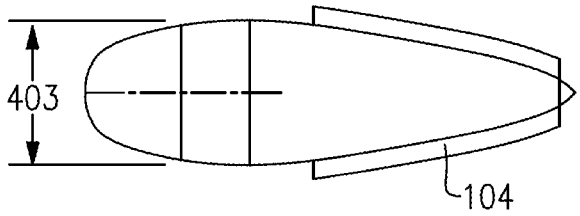
FIG. 4B shows a top view of the steering control fin of FIG. 4A having a thickness dimension.
Figure 4A:
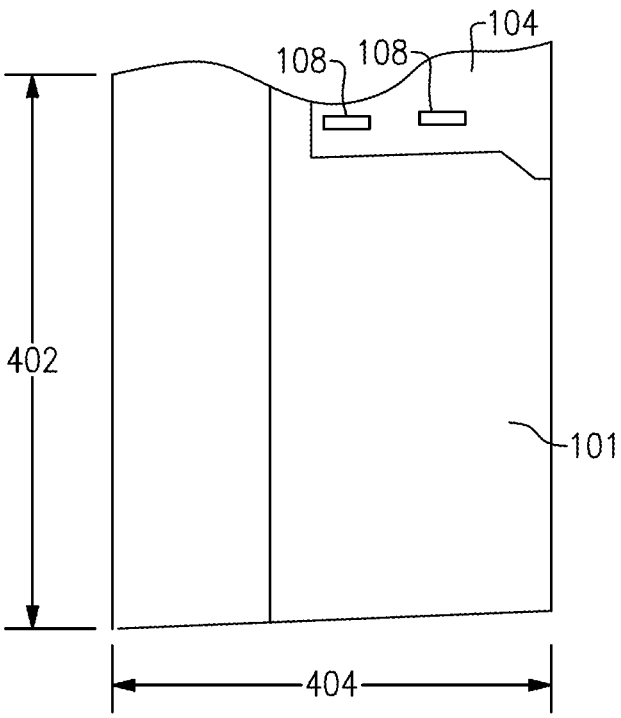
FIG. 4A shows a side view of the exemplary steering control fin of FIG. 1.
Figure 4C:
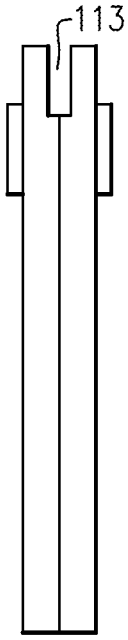
FIG. 4C shows a rear view of the steering control fin of FIG. 4A illustrating an exemplary anti-rotation interlock cut-out.
Figure 4D:
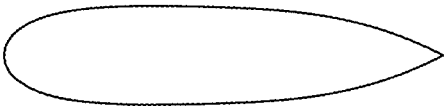
FIG. 4D shows a bottom view of the steering control fin of FIG. 4A illustrating an exemplary bottom insert.

FIG. 4A shows a side view of the exemplary steering control fin 100 of FIG. 1. The steering control fin 100 has a fin length dimension 402, and a fin width dimension 404. Exemplary slots 108 allow for the passage of attachment clamps 105 that hold the steering control fin 100 to a trolling motor. FIG. 4B shows a top view of the steering control fin 100 of FIG. 4A having a fin thickness dimension 403. FIG. 4C shows a rear view of the steering control fin 100 of FIG. 4A including the anti-rotation interlock cut-out 113. FIG. 4D shows a bottom view of the steering control fin 100 of FIG. 4A illustrating a bottom insert 110.

Example: In one exemplary embodiment for a steering control fin 100 to be mounted to a small fishing boat trolling motor, fin length dimension 402 can be about 16 inches, fin width dimension 404 can be about 8½ inches, and the fin thickness dimension 403 can be about 2¾ inches.

Figure 5:
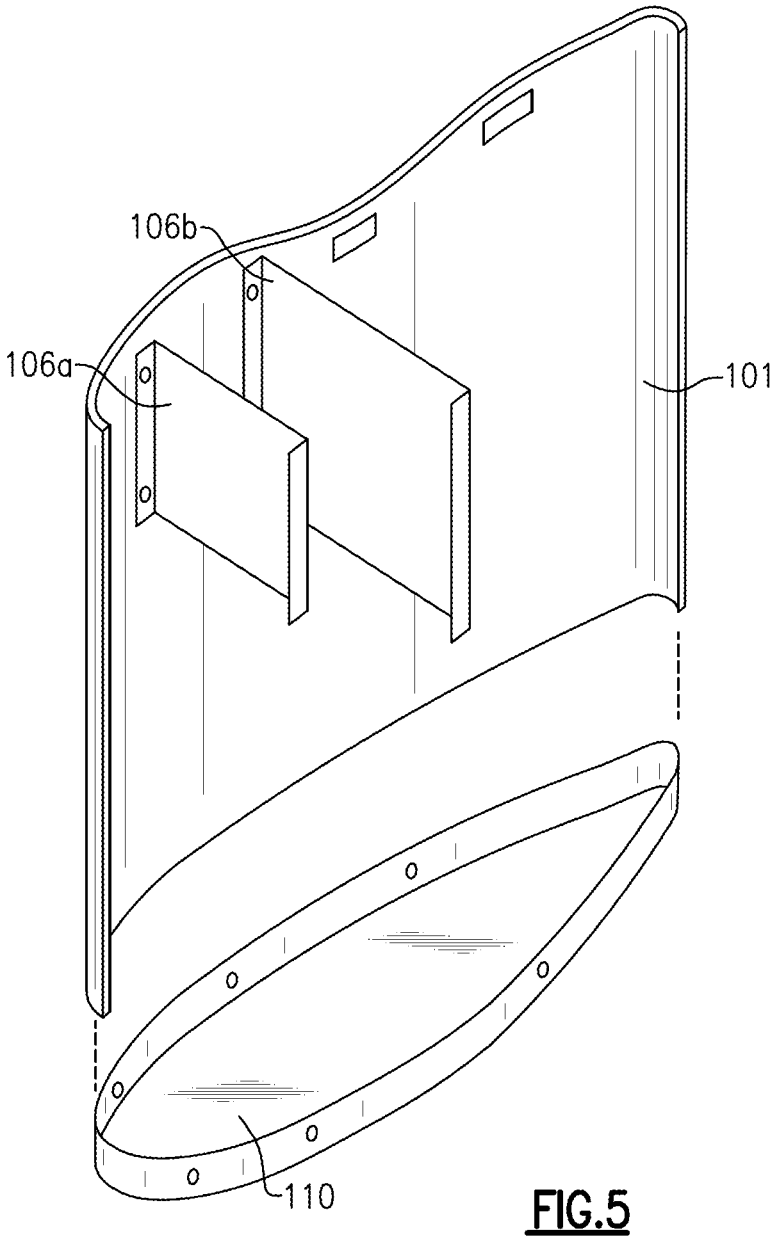
FIG. 5 shows a cut-away view of the exemplary steering control fin of FIG. 1.

FIG. 5 shows a cut-away view of the exemplary steering control fin 100 of FIG. 1 that better illustrates the exemplary inner short baffle 106*a* and inner long baffle 106*b* as well as illustrating how a bottom insert 110 including a folded section flange 111 can attach to the skin 101.

Example: An exemplary steering control fin as described hereinabove was implemented and tested with a trolling motor and prop.

Figure 6:
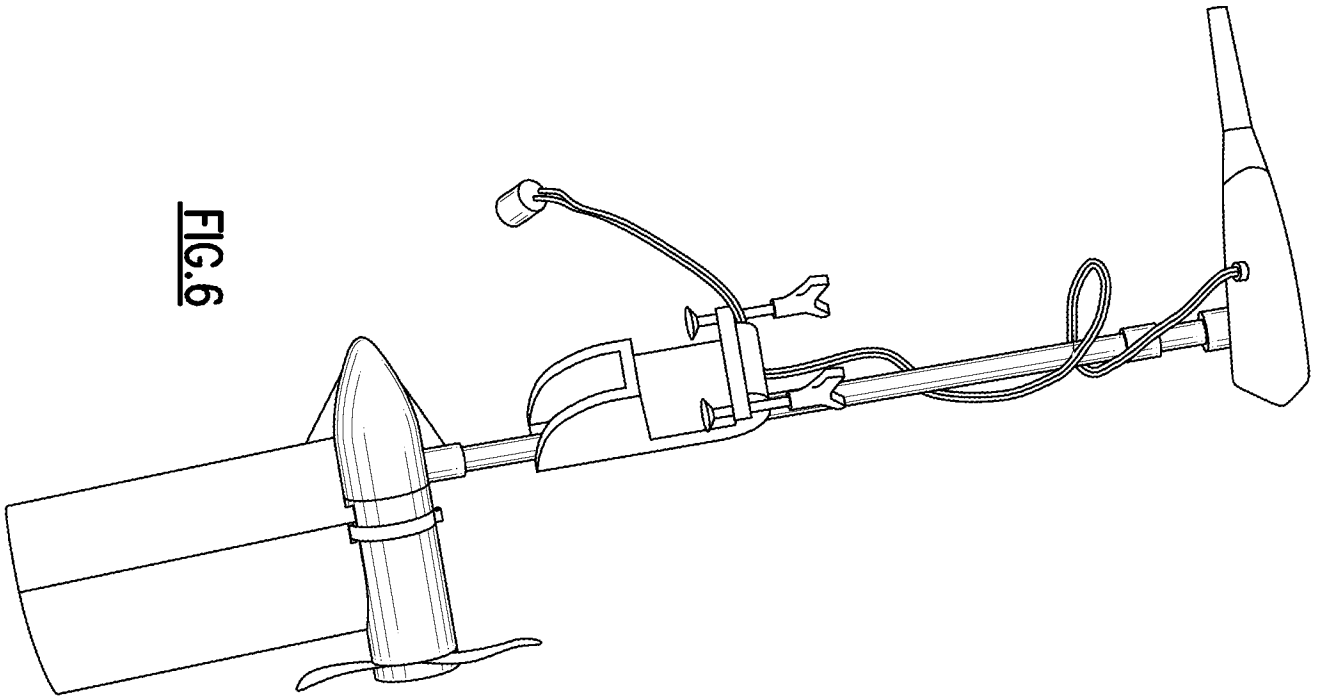
FIG. 6 shows an illustration of a trolling motor assembly having attached thereto an exemplary embodiment of a steering control fin.

FIG. 6 shows an illustration of a trolling motor assembly having attached thereto an exemplary embodiment of a steering control fin as described hereinabove attached by one attachment clamp and an anti-rotation interlock cut-out to a trolling motor.

Figure 7:
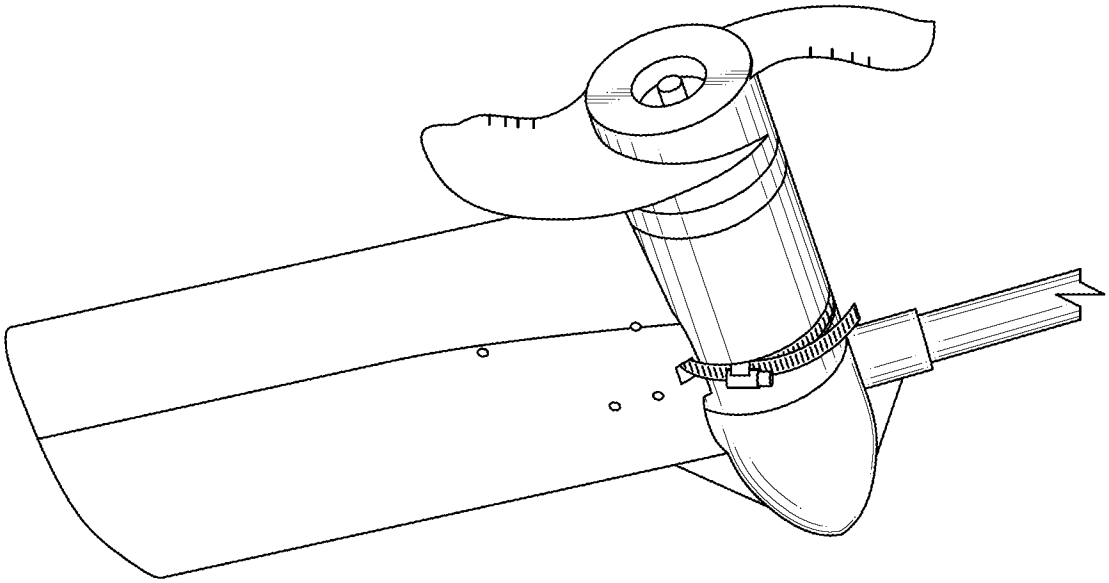
FIG. 7 shows a front angled view of the steering control fin attached to the trolling motor of FIG. 6.

FIG. 7 shows a front angled view of the steering control fin attached to a trolling motor of FIG. 6.

Figure 8:
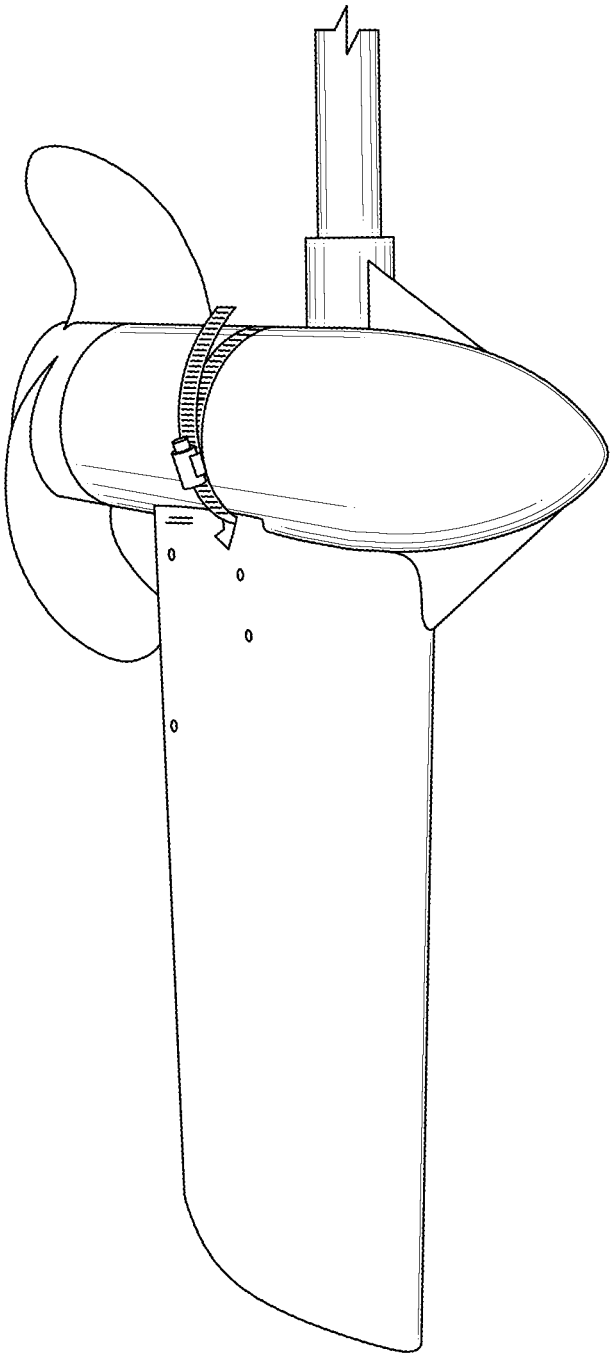
FIG. 8 shows a rear angled view of the steering control fin attached to the trolling motor of FIG. 6.

FIG. 8 shows a rear angled view of the steering control fin attached to a trolling motor of FIG. 6.

Figure 9:
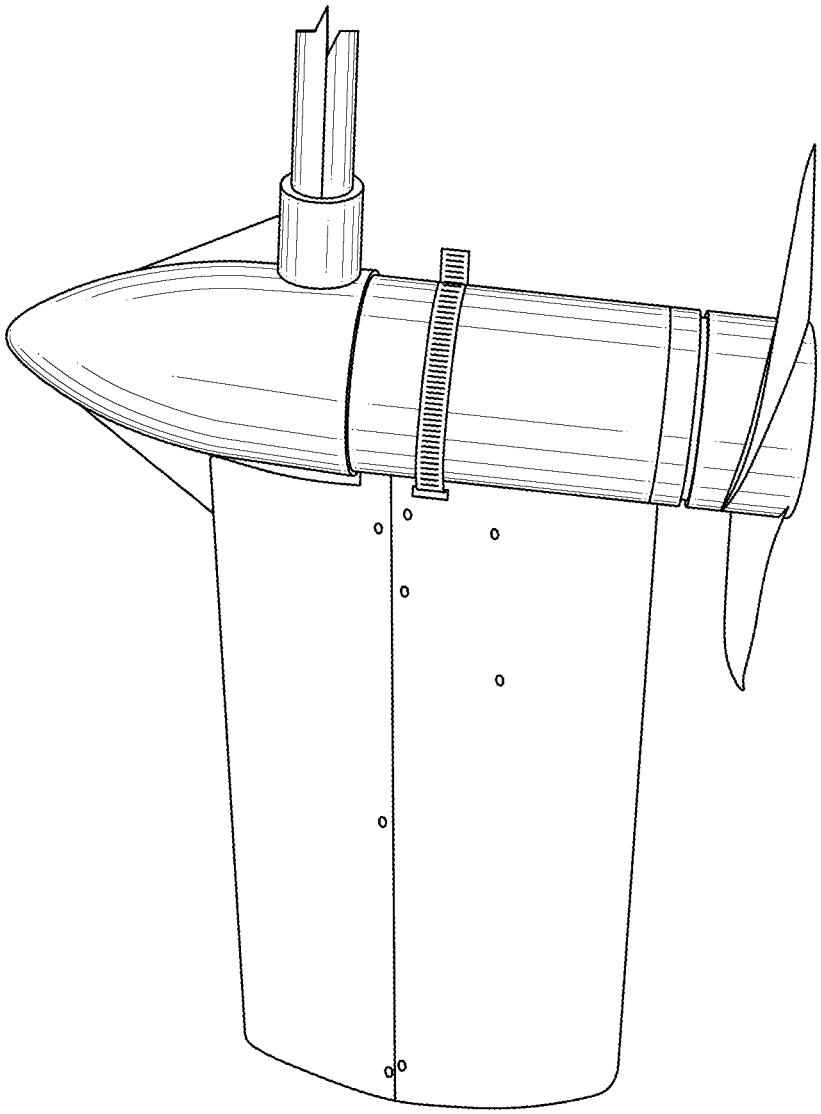
FIG. 9 shows a side view of the steering control fin attached to the trolling motor of FIG. 6.

FIG. 9 shows a side view of the steering control fin attached to a trolling motor of FIG. 6.

Figure 10:
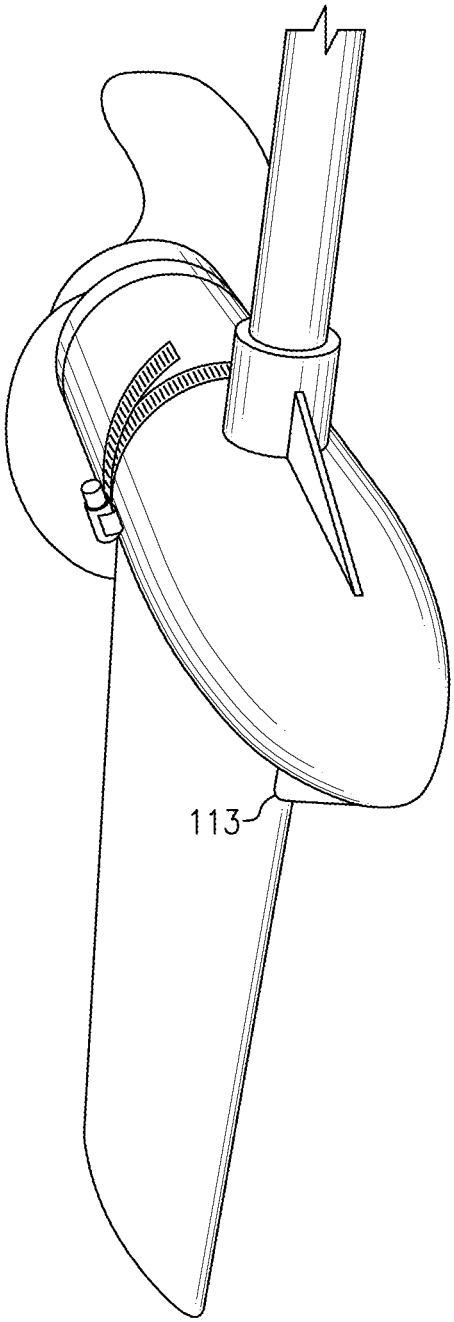
FIG. 10 shows a rear view from above of the steering control fin attached to the trolling motor of FIG. 6 illustrating an exemplary anti-rotation interlock cut-out.

FIG. 10 shows a rear view from above of the steering control fin attached to a trolling motor of FIG. 6 illustrating an exemplary anti-rotation interlock cut-out.

Figure 11A:
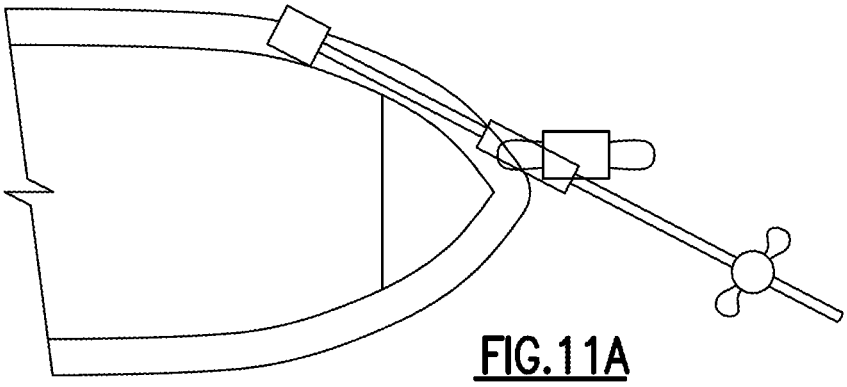
FIG. 11A shows a top view of a trolling motor having a steering control fin attached.

FIG. 11A shows a top view of a trolling motor having a steering control fin attached. The exemplary embodiment of FIG. 11A shows a small fishing boat bow mounted trolling motor fitted with a steering control fin attached to the most downward end of the steering tube assembly to improve drift direction due to wind and wave effect and to provide enhanced heading maneuvering during slow forward motion, such as by the stem motor's troll setting. A secured transom location for the bow trolling motor is shown over laying the drawing of the deployed trolling motor.

Figure 11B:
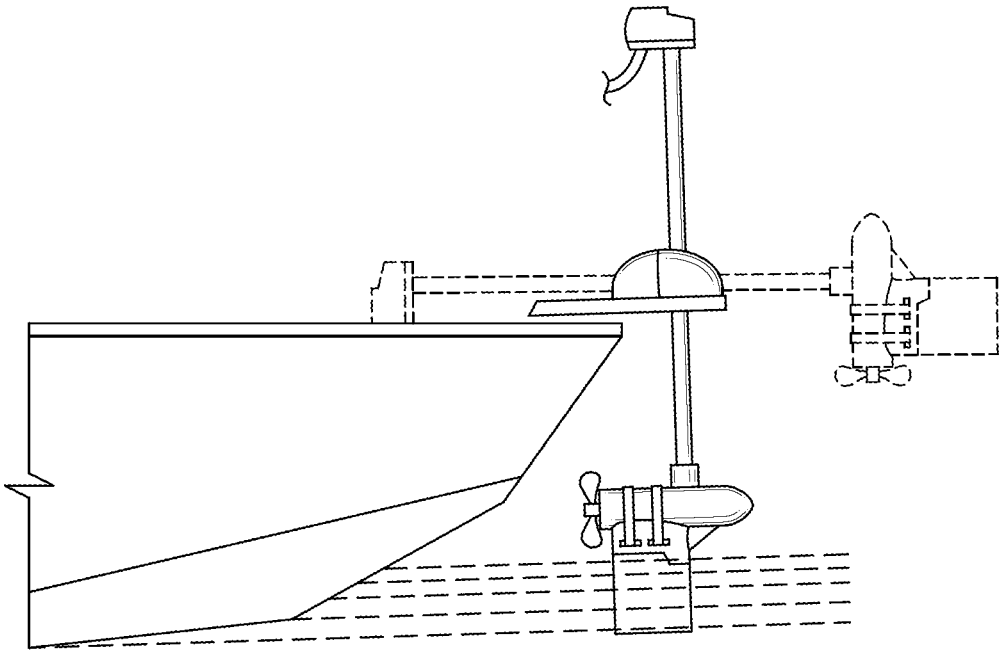
FIG. 11B shows a side view of a trolling motor having a steering control fin attached.

FIG. 11B shows a side view of a trolling motor having a steering control fin attached as a pivoting work station, shown both in a non-deployed and a deployed position.

Figure 12:
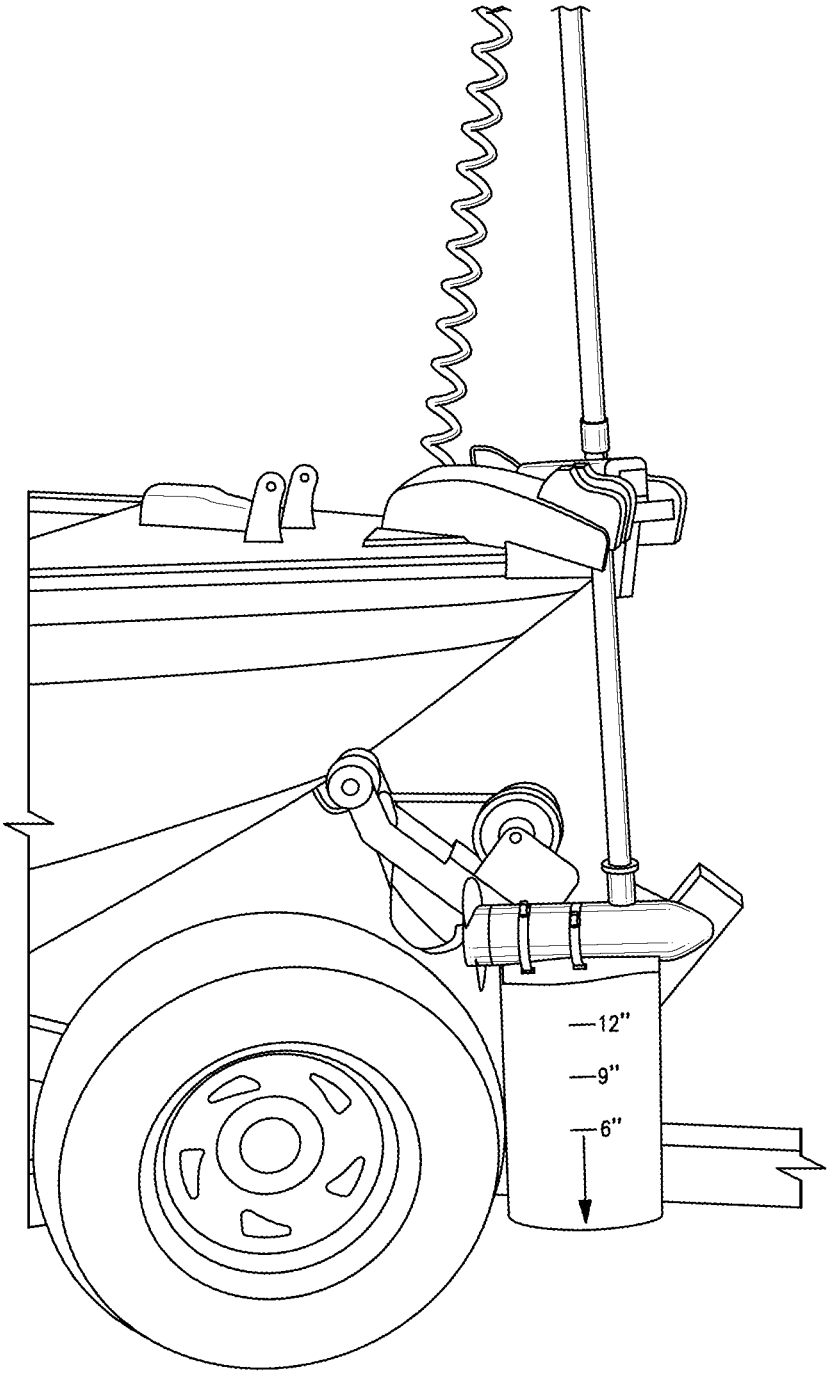
FIG. 12 shows an exemplary illustration of a trolling motor having a steering control fin with depth markings.

FIG. 12 shows an exemplary illustration of a trolling motor having a steering control fin with depth markings. A plurality of depth indication marks on the skin can be helpful for adjusting the depth of the steering control fin for trolling conditions, water depth and/or draft, or for a specific steering control fin use or application, such as the exemplary uses and applications described herein above.

Figure 13:
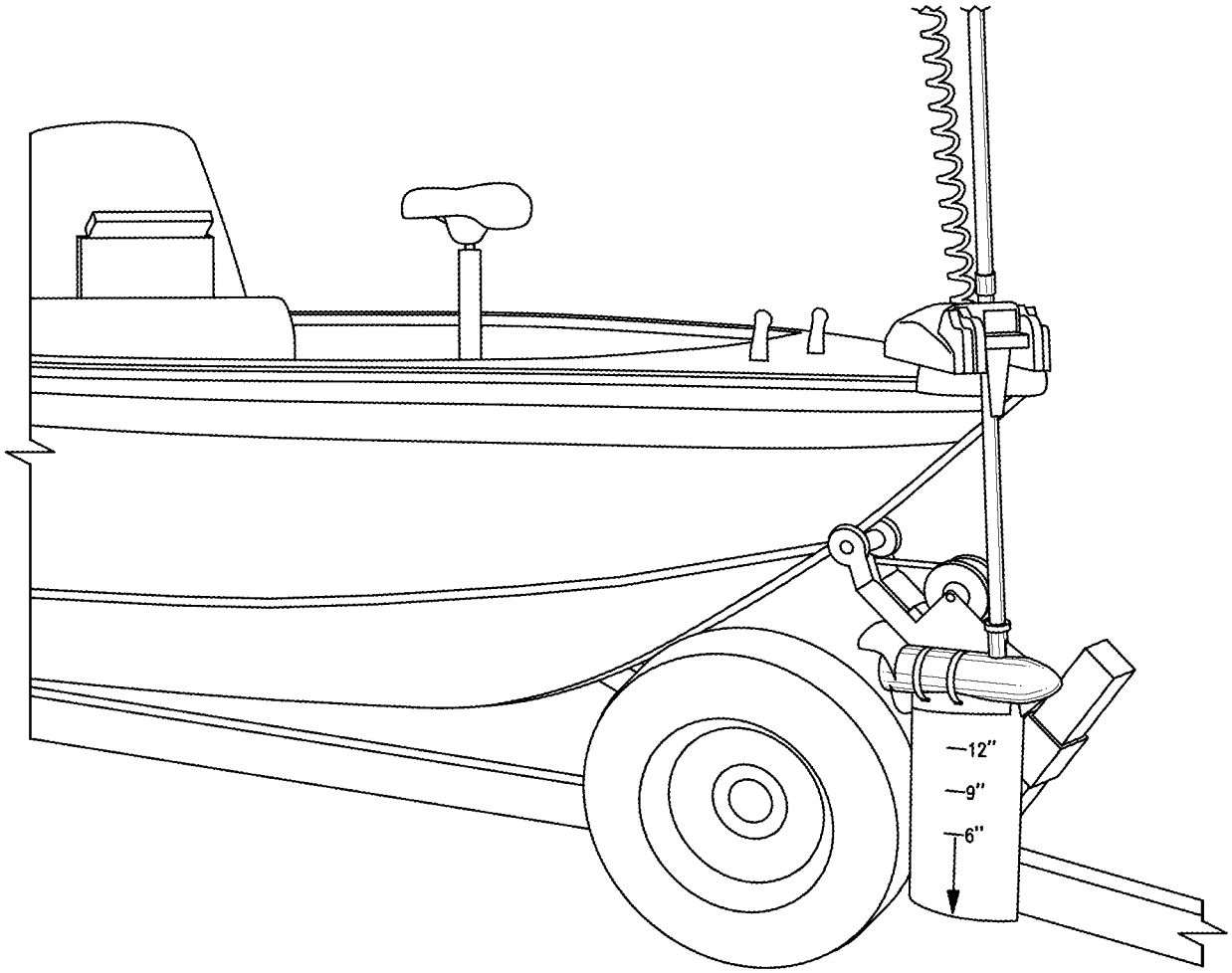
FIG. 13 shows another exemplary view of the steering control fin of FIG. 12.

FIG. 13 shows another exemplary view of the steering control fin of FIG. 12.

Figure 14:
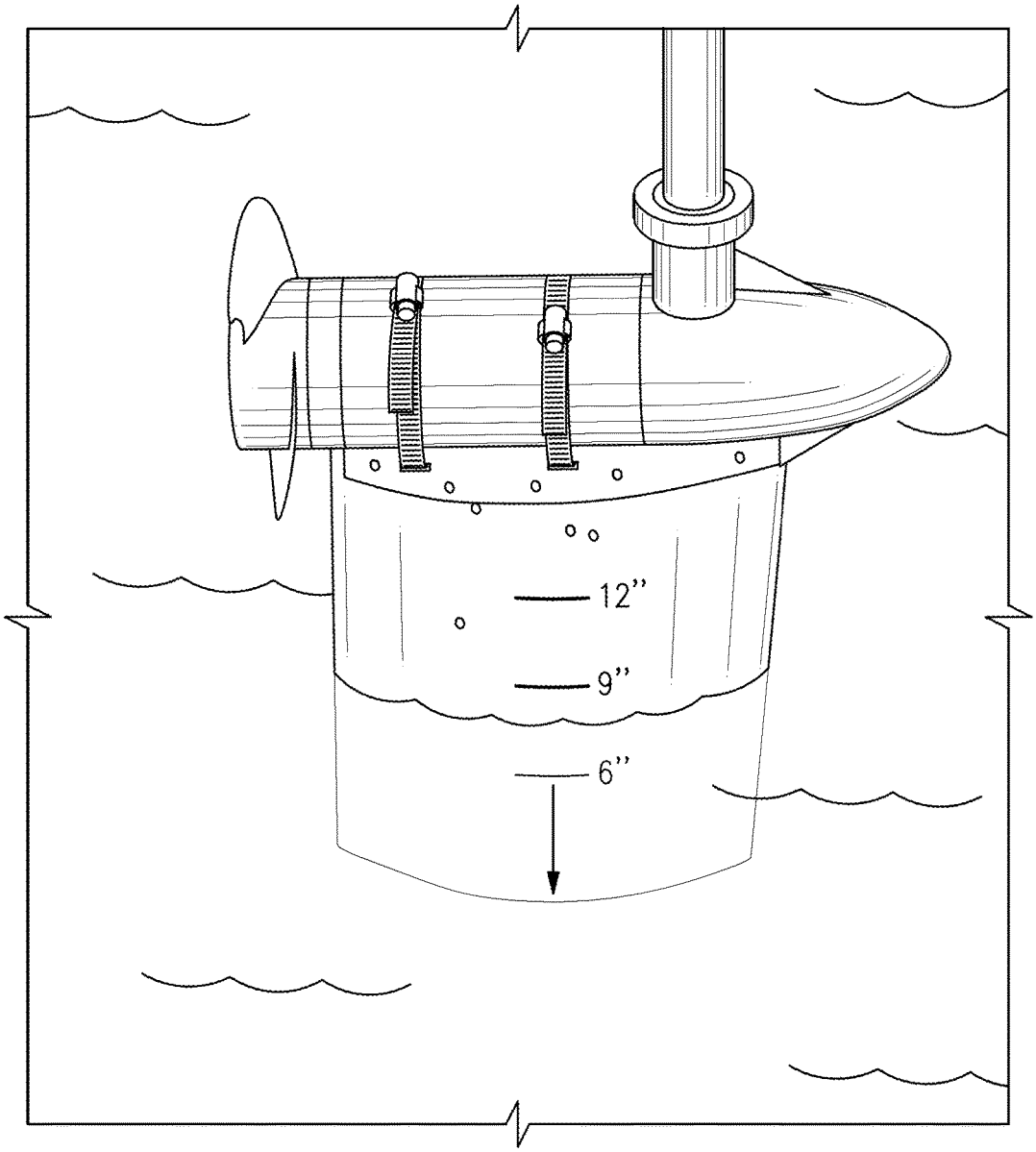
FIG. 14 shows an exemplary illustration of a steering control fin with depth markings deployed to a depth of 9 inches.

FIG. 14 shows an exemplary illustration of a steering control fin with depth markings deployed to a depth of 9 inches.

Figure 15:
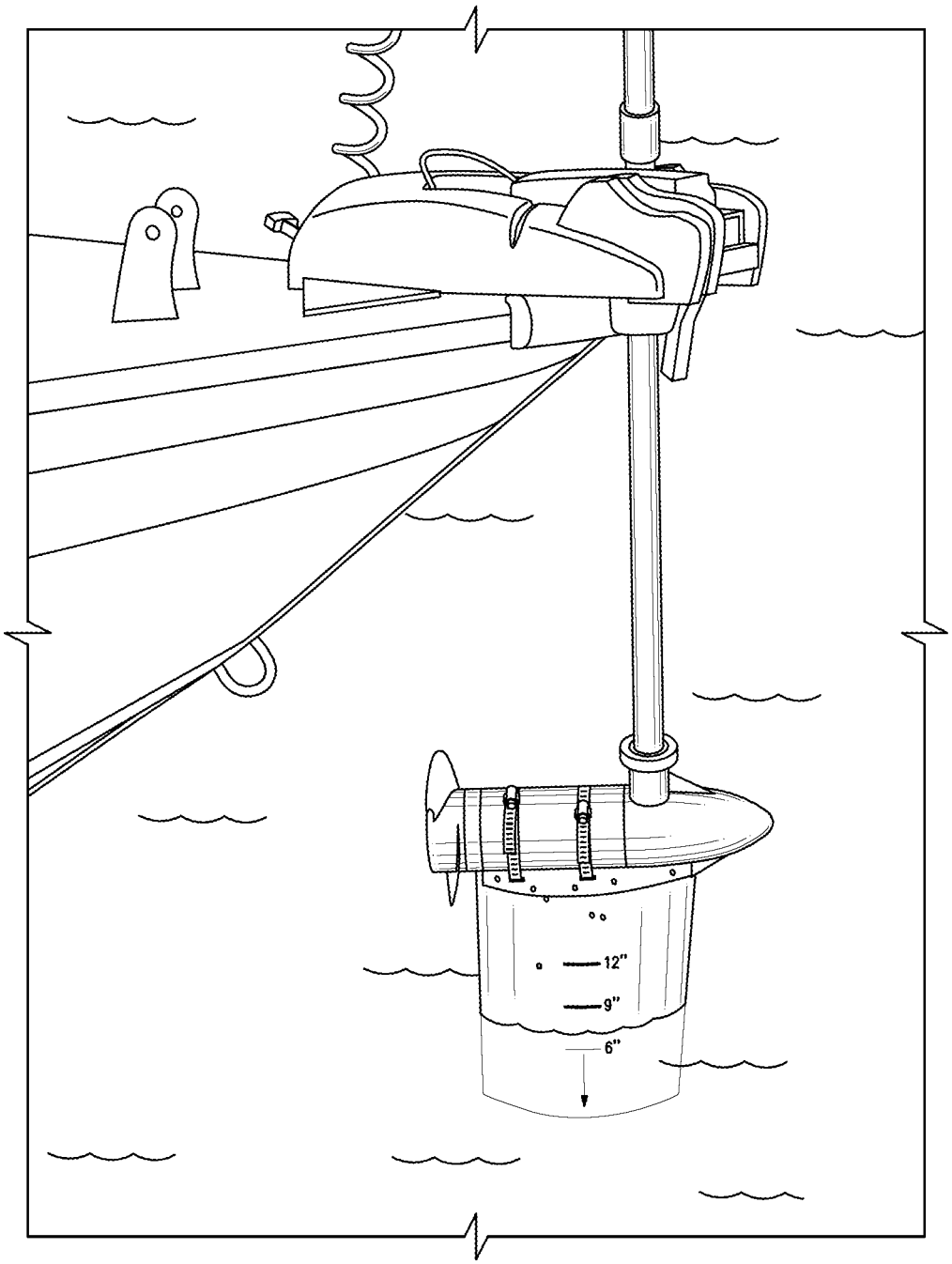
FIG. 15 shows another view of the steering control fin of FIG. 14.

FIG. 15 shows another view of the steering control fin of FIG. 14.

Figure 16:
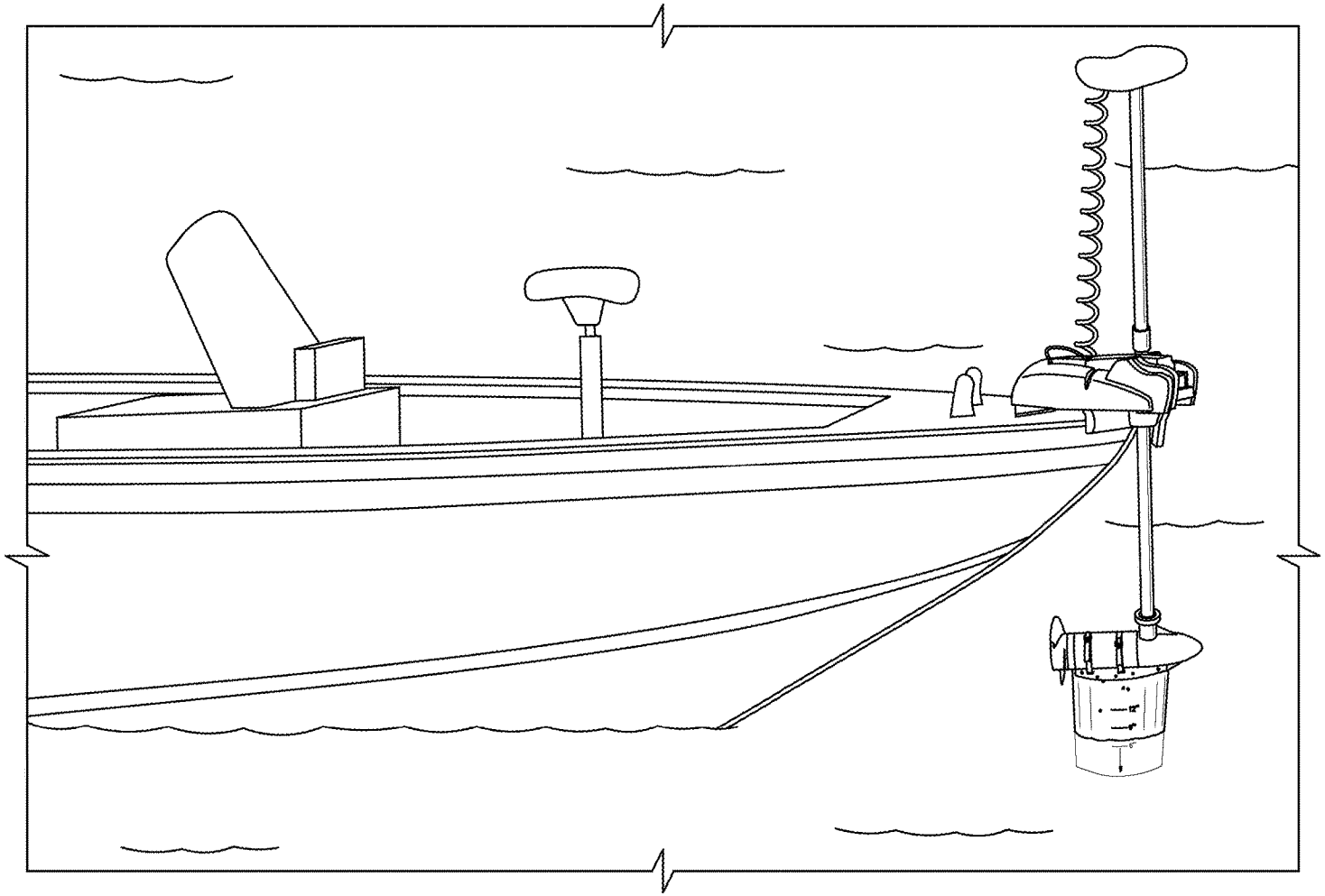
FIG. 16 shows an exemplary illustration of the steering control fin of FIG. 14 underway.

FIG. 16 shows an exemplary illustration of the steering control fin of FIG. 14 underway.

In some embodiments, the steering control fin has a forward edge and a trailing edge and the forward edge and the trailing edge are substantially symmetric from fore to aft. In some embodiments, either of the forward edge and the trailing edge are tapered from near the propulsion unit to a distal end of the steering control fin farthest below the propulsion unit (e.g. a trolling motor). In other embodiments, both of the forward edge and the trailing edge are tapered from near the propulsion unit to a distal end of the steering control fin farthest below the propulsion unit (e.g. a trolling motor). Where both of the forward edge and the trailing edge are tapered, they may have the same taper or a different taper. Also, in some embodiments, the steering control fin can have an airfoil shaped body that is typically, but not necessarily symmetric side to side.

Trolling motors suitable for use with the steering control fin as described hereinabove include trolling motors made by MotorGuide™. Exemplary suitable MotorGuide™ trolling motors include the Xi5 series wireless-bow mounted trolling motors with foot pedal, the Xi5 series wireless-bow mounted trolling motors with sonar transducer, and the Xi5 series wireless-bow mounted trolling motors with sonar transducer and Pinpoint GPS with digital variable speed. Other exemplary suitable MotorGuide™ trolling motors include the X3 foot controlled bow mount series and the X3 hand operated series. Still other exemplary suitable trolling motors include the Minn Kota™ Maxxum digital bow mounted trolling motors, the Minn Kota™ pontoon hand-control series trolling motors, the Minn Kota™ i-Pilot wireless GPS trolling system, and the Minn Kota™ ST/Riptide SP trolling motors.

In some applications, ranging from small trolling motors to larger steering control fins for commercial ship applications, it is contemplated that the steering control fin can be retractable so as to be retracted when not in use.

It is also contemplated that one or more steering control fins can be mounted on the side of a vessel instead of, or in addition to a bow mounted steering control fin.

It is also contemplated that the steering control fin of the instant application can be applied to an auxiliary propulsion unit of a larger vessel ranging from a large boat to ships and naval vessels. For example, a steering control fin with additional support and/or structural features as known in the art of naval architecture could be attached to an Azipod™ type propulsion unit available from the ABB Corporation.

While propulsion units ranging from small trolling motors to Azipods™ may have existing small fins, typically such small fins extend only to about the radius of the propeller, or a small distance beyond. Such small fins add little to vessel maneuverability and generally are more important to protect the propeller or a propulsion pod, such as, for example, by operating as a skid to keep the propeller from contacting a bottom surface obstruction. By contrast, it was realized as described herein, that in some embodiments, adding a more significant length fin that extends more than one propeller radius below the propeller or propulsion unit, or in other embodiments, which extends two or more propeller radii below the propulsion unit, the fin becomes a steering control fin which significantly improves vessel maneuverability at slow vessel speed. In some embodiments, the steering control fin extends more than three propeller radii below the propeller of a trolling motor. In propulsion units using other propulsion technologies than propellers, a steering control fin can extend one or more, two or more, or three or more radii or height dimension of the housing of the propulsion unit. In addition to attachment below an auxiliary propulsion unit, a steering control fin as described herein, again with additional support and/or structural features as known in the art of naval architecture is also believed applicable to auxiliary propulsion units of hydra-foil vessels of any size.

Method: A method of trolling includes the steps of providing a steering control fin mounted substantially below a trolling motor and having a sufficient fin thickness to cause a drag; trolling at a relatively slow speed, slower than without the drag of the steering control fin; and changing a direction of the boat rapidly by changing the direction of the trolling motor having the steering control fin affixed thereto. Further maneuverability can be achieved by combining steering action from a main motor direction and or the rudder of the boat combined with the directional control of the steering control fin, such as a bow mounted steering control fin. Also, as known in the art, the trolling motor direction can be set by a foot pedal.

According to another method of fishing by trolling: maneuvering a boat for fishing by trolling includes the steps of: providing a steering control fin mounted below a trolling propulsion unit by two or more radii of a trolling propulsion unit propeller below a bow or side mounted trolling propulsion unit of the boat, the steering control fin having a fin thickness that causes a substantial drag while allowing maneuverability; trolling at a relatively slow speed, by use of the substantial drag caused by the steering control fin; and changing a direction of the boat rapidly by steering the bow or side mounted trolling propulsion unit having the steering control fin affixed thereto for improved maneuverability.

According to yet another method of fishing by trolling with a foot directional controlled trolling motor having a steering control fin comprising the steps of: providing a steering control fin extending more than two propeller radii below a trolling motor propeller, the steering control fin mechanically coupled to and mounted substantially below a bow mounted trolling motor of a boat, the steering control fin having a fin thickness that causes a substantial drag while allowing maneuverability; trolling at a relatively slow speed, by use of the trolling motor as modified by a substantial drag caused by the steering control fin; detecting a school of fish as indicated by a fish finder or two or more bites or nibbles by fish on two or more trolling lines within a predetermined length of time; and starting a main propulsion motor and changing a direction of the boat rapidly to remain in a vicinity of the school of fish by steering the steering control fin by a trolling motor direction control by foot operation irrespective of whether of the trolling motor is operating or not.

While the present invention has been particularly shown and described with reference to the preferred mode as illustrated in the drawing, it will be understood by one skilled in the art that various changes in detail may be affected therein without departing from the spirit and scope of the invention as defined by the claims.

What is claimed is:

1. A steering control fin for mounting to a trolling motor including:

a skin formed into a substantially symmetric closed fin shape having a fin width, the skin having a first end surface contoured to match the shape of a motor, and a trailing edge having an anti-rotation interlock cut-out near the first end surface;

a pair of reinforcement collars, each reinforcement collar of the pair of reinforcement collars affixed to each of a first side and a second side of the steering control fin and having a reinforcement collar surface that substantially matches the first end surface;

an internal support structure mechanically coupled to the first side and the second side of the steering control fin that provides a structural support which maintains the substantially symmetric closed fin shape;

an end cap skin mechanically coupled to a second end surface of the skin; and one or more mounting straps mechanically coupled to the skin and each of the reinforcement collars mechanically affix the control fin to the trolling motor.

2. The steering control fin of claim 1, wherein the skin includes a metal.

3. The steering control fin of claim 2, wherein the metal includes galvanized steel or aluminum.

4. The steering control fin of claim 1, wherein the skin includes a non-metallic material selected from the group consisting of a plastic, a carbon composite and a fiber glass.

5. The steering control fin of claim 1, wherein the skin includes an overlapping seam.

6. The steering control fin of claim 5, wherein the overlapping seam includes a plurality of rivets.

7. The steering control fin of claim 1, wherein the internal support structure includes one or more internal baffles.

8. The steering control fin of claim 1, wherein the internal support structure is mechanically coupled to the skin by a plurality or rivets.

9. The steering control fin of claim 1, wherein the one or more mounting straps include adjustable clamps.

10. The steering control fin of claim 1, wherein the fin width is more than about one tenth of a fin length dimension so as to cause substantial drag while allowing for maneuverability.

11. The steering control fin of claim 1, further comprising a plurality of depth indication marks on said skin.

12. The steering control fin of claim 1, wherein said steering control fin comprises a forward edge and a trailing edge and said forward edge and said trailing edge are substantially symmetric from fore to aft.

13. A method of fishing by trolling with a foot directional controlled trolling motor having a steering control fin comprising the steps of:

providing a steering control fin extending more than two propeller radii below a trolling motor propeller, said steering control fin mechanically coupled to and mounted substantially below a bow mounted trolling motor of a boat, the steering control fin having a fin thickness that causes a substantial drag while allowing maneuverability;

trolling at a relatively slow speed, by use of the trolling motor as modified by a substantial drag caused by the steering control fin;

detecting a school of fish as indicated by a fish finder or two or more bites or nibbles by fish on two or more trolling lines within a predetermined length of time; and starting a main propulsion motor and changing a direction of the boat rapidly to remain in a vicinity of the school of fish by steering the steering control fin by a trolling motor direction control by foot operation irrespective of whether of the trolling motor is operating or not.

* * * * *